US005445225A

United States Patent [19]

Wiggins, Sr.

[11] Patent Number: 5,445,225

[45] Date of Patent: Aug. 29, 1995

[54] CHOKE FOR ENHANCED GAS AND OIL WELL PRODUCTION

[76] Inventor: Merl D. Wiggins, Sr., 8227 Misty Oaks Ave., Baker, La. 70714

[21] Appl. No.: 298,973

[22] Filed: Sep. 2, 1994

[51] Int. Cl.[6] ..... E21B 34/00

[52] U.S. Cl. ..... 166/319; 166/227

[58] Field of Search ..... 166/250, 314, 320, 321, 166/325, 369, 142, 167, 188, 195

[56] References Cited

U.S. PATENT DOCUMENTS

| | | | |
|---|---|---|---|
| 216,064 | 6/1879 | Spencer . | |
| 1,039,496 | 9/1912 | Daniels et al. . | |
| 1,837,788 | 12/1931 | Miller | 166/142 |
| 1,916,070 | 6/1933 | Otis . | |
| 2,095,899 | 10/1937 | Yancey | 166/195 |
| 3,136,368 | 6/1964 | Wents et al. . | |
| 3,189,316 | 6/1965 | Preston, Jr. . | |
| 3,318,386 | 5/1967 | Garrett et al. . | |
| 3,437,135 | 4/1969 | Cox et al. | 166/195 |
| 3,850,191 | 11/1974 | Brown . | |
| 3,941,511 | 3/1976 | Morgan . | |
| 4,036,297 | 7/1977 | Swihart, Sr. . | |
| 4,210,208 | 7/1980 | Shanks . | |
| 4,390,061 | 6/1983 | Short | 166/53 |
| 4,605,074 | 8/1986 | Barfield . | |
| 5,314,018 | 5/1994 | Cobb | 166/265 |
| 5,327,960 | 7/1994 | Cornette et al. . | |

FOREIGN PATENT DOCUMENTS

| | | |
|---|---|---|
| 190843 | 11/1967 | U.S.S.R. . |
| 1231208A | 5/1986 | U.S.S.R. . |
| 1298334A | 3/1987 | U.S.S.R. . |
| 1375801A | 2/1988 | U.S.S.R. . |
| 1461872A | 2/1989 | U.S.S.R. . |
| 1772344A | 10/1992 | U.S.S.R. . |

*Primary Examiner*—Ramon S. Britts
*Assistant Examiner*—Frank S. Tsay
*Attorney, Agent, or Firm*—Richard C. Litman

[57] ABSTRACT

The claimed apparatus is a bottom hole choke device for regulating the flow within gas and oil producing wells. The apparatus includes a screen for preventing sand from entering the production string, a flow-restricting choke, and a check valve for preventing back flow into the well.

19 Claims, 1 Drawing Sheet

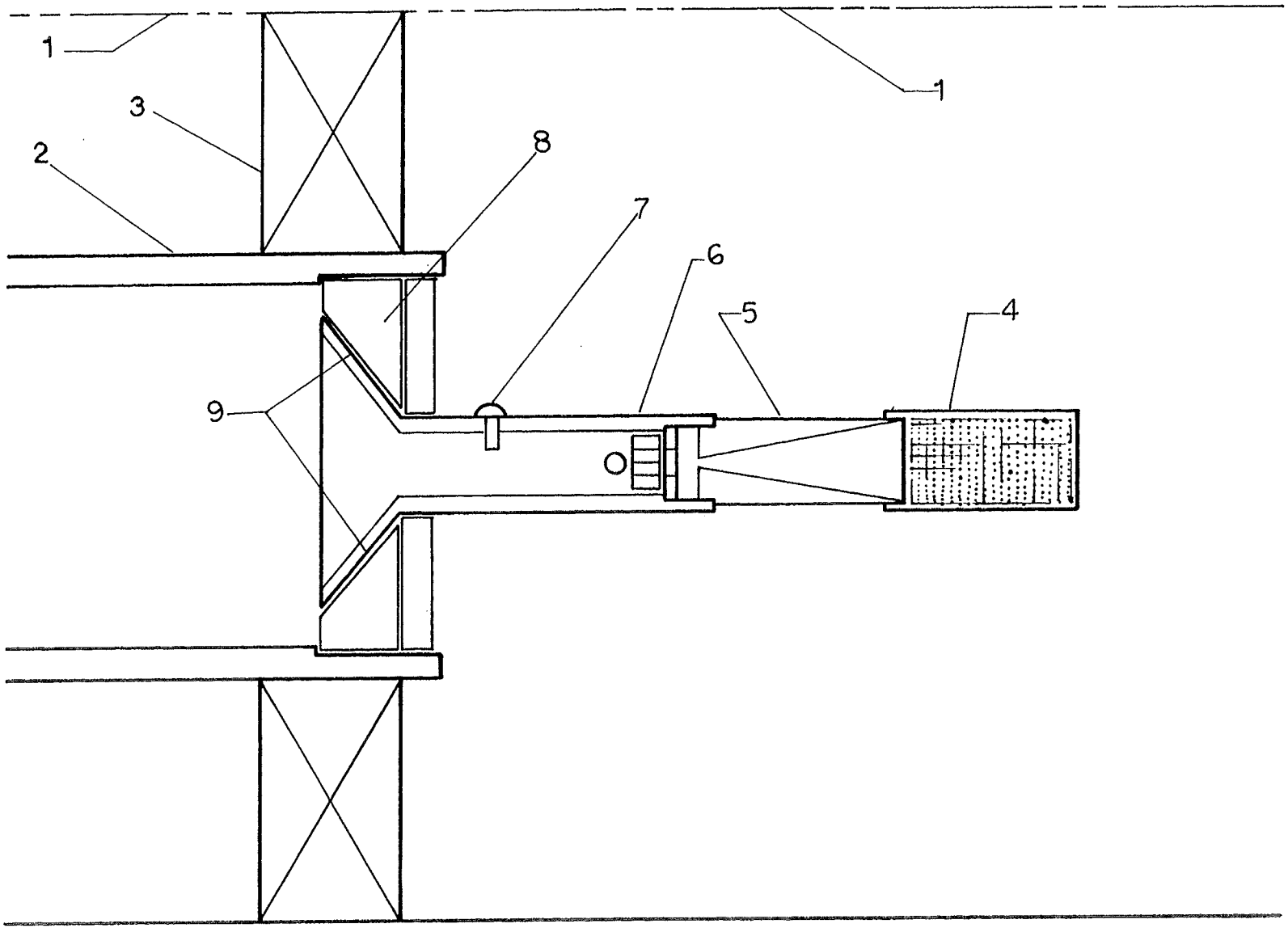
1
2
3
4
5
6
7
8
9
1

CHOKE FOR ENHANCED GAS AND OIL WELL PRODUCTION

BACKGROUND OF THE INVENTION

1. FIELD OF THE INVENTION

The present invention relates to pressure controlling devices for regulating the pressure and flow within gas and oil-producing wells. More specifically, the present invention is a choke-type device which maintains bottom hole pressure at a substantially constant level while greatly reducing the amount of sand and water entering the production string.

2. DESCRIPTION OF THE PRIOR ART

Oil and gas well pressure controlling devices are well known in the art. Many different choke-type devices and the like are described in the patent literature. For instance, an early patent, U.S. Pat. No. 216,064, issued Jun. 3, 1879, to Samuel Spencer, describes an apparatus for regulating the flow of oil in wells. The apparatus is placed inside a standard well which includes an outer casing having a perforated lower end, and an inner tube placed inside the outer casing. A packer is placed in the annulus between the outer casing and the inner tube to both force gas and oil into the inner tube and to prevent water from upper strata from contaminating the oil present in the lower reaches of the casing. The apparatus includes a funnel placed within the inner tube, and a standing valve which allows oil to pass upward through the valve, but blocks oil from descending back down the well. The major draw back to this device is that the sand and sediment which passes the standing valve will be lifted to the surface along with the oil, thereby necessitating a subsequent filtration step to remove the sediment from the oil. It is just this step that the present invention aims to eliminate by greatly lessening the amount of contaminants which enter the production string of the well.

U.S. Pat. No. 1,039,496, issued Sep. 24, 1912, to Daniels et al, describes an expanding sleeve for releasably sealing a standing valve within the inner tube of an oil well. The sleeve ensures a snug fit between the inner tube and the standing valve so as to prevent oil from passing around the outer periphery of the standing valve.

H. C. Otis describes a bottom hole choke in U.S. Pat. No. 1,916,070, issued Jun. 27, 1933. The choke includes a releasable closure located at the mouth of the choke, and a passage tube to communicate pressurized gas which accumulates at the top of the well to the bottom of the well. The closure is opened to admit oil into the inner tube, and the passage tube is then opened to allow the pressurized gas from the top of the well to expand into the bottom of the well, This is then utilized to lift the oil to the surface.

U.S. Pat. No. 2,095,899, issued Oct. 12, 1937, to J. R. Yancy, discloses another type of removable bottom hole choke. The choke is preferably formed within a single unitary housing, both to facilitate ease of insertion and removal of the choke, and to ensure a tight fit of the choke within the inner tube. The choke housing also includes an assembly which is matingly engageable with a setting tool for placing and removing the choke from within the inner tube.

Wents et al describe an apparatus for controlling the flow of liquid within a well casing in U.S. Pat. No. 3,136,368, issued Jun. 9, 1964. The apparatus includes a ball trapped within a cage, and a flexible diaphragm disposed within the cage, The diaphragm has an opening therethrough through which the ball can pass if motivated to do so with sufficient force. When the apparatus is lowered into a well, the ball is forced to the upper limit of the cage, and liquid flows freely through the opening in the diaphragm, and around the ball. However, when back pressure is sufficiently high, the ball will be forced against the diaphragm and against the lower limit of the cage, thereby forming a seal to prevent the back flow of liquid down the well.

U.S. Pat. No. 3,189,316, issued Jun. 15, 1965, to D. C. Preston, Jr., describes a sub-surface choke-like apparatus for inducing the flow of fluid in a well. The apparatus is a valve device designed to create a high pressure differential across the perforations at the lower end of the well casing. The high pressure differential causes a sudden flow of liquid from the geological formation into the casing, which clears accumulated silt from the perforations. The silt, which has now entered the production string of the well, is lifted to the surface, where it must be separated from the oil. In contrast to this apparatus, the present invention creates enhanced flow within a well while simultaneously reducing the amount of sand, silt and water entering the production string. While the Preston device may enhance liquid flow, it will also increase the amount of sand lifted to the surface.

U.S. Pat. No. 3,318,386, issued May 9, 1967, to H. U. Garrett et al, describes a well fluid flow regulator. The regulator comprises a pressure sensitive assembly which is placed at the bottom of the well bore. Pressure data from the assembly is used to calculate the back pressure needed to maintain a substantially constant "sand-face differential." The sand-face differential is the pressure gradient from a point within the oil-producing formation to a point within the well casing. Opening and closing of secondary valves in response to the pressure data is used to maintain a constant sand-face differential, which results in more efficient utilization of the oil-bearing formation.

C. C. Brown describes a check valve assembly for preventing the reverse flow of drilling fluid down a well in U.S. Pat. No. 3,850,191, issued Nov. 26, 1974. The valve includes a conical valve body, a ball closure which normally rests outside of the flow path of the well, and a seat for the ball. The ball of the valve, normally outside of the fluid flow, is responsive to the rate of reverse flow through the valve body. At a predetermined level of reverse flow, the ball will be urged into the flow path and seat in the valve, thereby preventing back flow down the well.

U.S. Pat. No. 3,941,511, issued Mar. 2, 1976, to Thomas Morgan, describes an apparatus for artificially lifting oil to the surface after the bottom hole pressure has decreased to a point that artificial lift becomes necessary. The apparatus includes an accumulator placed within the lower reaches of the well casing, with the uppermost portion of the accumulator being vented to the surface. A floating piston-type device is positioned above the accumulator, within the production string, and a stinger tube defines a connection between the accumulator and the production string above the floating piston. Pressure applied to the vent line forces oil from the accumulator to the production zone above the floating piston. The piston is then used to lift the oil to the surface. When the piston reaches the top of its flight, additional pressure from the accumulator is vented into the production line to aid in lifting the oil to the surface and to simultaneously relieve pressure from below the floating piston to allow it to sink back to the bottom of the production tubing. The cycle is then repeated.

U.S. Pat. No. 4,036,297, issued Jul. 19, 1977, to Patrick Swihart, Sr., discloses a bottom hole flow control apparatus which modifies well flow in a pulse-flow type manner. Through the cooperation of a piston chamber, production inlet and production outlet chambers, and associated valves, the well can be closed in response to the occurrence of a particular flow rate through the production string. This more effectively utilizes the bottom hole pressure because the well can be "pulsed" to agitate the rising oil, and to close down production flow when flow rates become inefficiently high.

Related choke devices and gravel pack installations are described in U.S. Pat. No. 4,210,208, issued Jul. 1, 1980, to F. E. Shanks; U.S. Pat. No. 4,605,074, issued Aug. 12, 1986, to V. H. Barfield; and U.S. Pat. No. 5,327,960, issued Jul. 12, 1994, to H. M. Cornette et al.

A large number of flow control devices and methods have been described in the foreign patent literature as well, most notably from the former Union of Soviet Socialist Republics. Among these devices is the piping described in SU 190,843, issued Nov. 17, 1967. This reference discloses a set of interlocking pipe string sections in which the central-most section has the widest inner diameter, while both the bottom hole and top hole ends have substantially smaller inner diameters. In flowing through the expanding and then contracting production string, the oil is sharply expanded and contracted, which agitates the oil to extend the natural flow of the well.

The remaining Soviet documents disclose choke apparatuses, check valves, and related flow control devices which are cumulative to the above-discussed references. Included among these Soviet references are SU 1,231,208A, issued May 15, 1986; SU 1,298,334A, issued Mar. 23, 1987; SU 1,375,801A, issued Feb. 23, 1988; SU 1,461,872A, issued Feb. 28, 1989; and SU 1,772,344A; issued Oct. 30, 1992.

SUMMARY OF THE INVENTION

Ever since the first oil wells were drilled into Pennsylvania soil at the time of the American Civil War, big businessmen, entrepreneurs, and "wild-catters" have dreamed of hitting the big gusher, i.e. an oil formation whose geological pressure is so much higher than atmospheric pressure that the oil is spontaneously pushed from the formation to the surface. However, as was quickly discovered in the ensuing oil booms and busts, over-exploitation of proven oil bearing formations either exhausts the amount of pressure within the formation, or poisons the formation by the "coning" of water into the oil producing areas. (See below for a further discussion of coning.)

Once the pressure within the oil-bearing formation is depleted, the oil must be pumped, or "lifted" to the surface. This is a costly and laborious process which ultimately increases the cost of the oil lifted from the formation. The necessity to lift the oil to the surface also effectively lessens the amount of energy gained from a given formation since a large amount of energy must be exerted to lift the oil out of the ground.

In the early days of oil exploration, when oil was relatively scarce, oil wells were randomly, wildly, and haphazardly drilled throughout the United States, without regard to the damage being done to the geological formations themselves. At that time, the oil from a formation was allowed to flow unchecked until there was insufficient pressure at the bottom of the well to lift the oil to the surface. In the 1920's, lured by the dream of instant wealth, large reserves of oil and gas were discovered at Spindletop, and throughout the West Texas and Oklahoma panhandles. As soon as one well ran dry, another would be drilled. Outside the United States, the Royal Dutch/Shell Group had begun oil production in Sumatra, and the predecessor companies of what would become British Petroleum had begun drilling for oil in Iran. Soon, a world-wide oil glut contributed in large part to the Great Depression here in the United States.

During the Depression, in the U.S., oil production was strictly limited and rationed between the producing companies. The production quotas (promulgated by the Texas Railroad Commission) introduced the widespread use of choke devices to control the amount of oil flowing from an oil-bearing formation.

With the onset of World War Two, oil production throughout the world was maximized once again in a wild and ecologically, as well as economically, unsound fashion. It was at this time that the truly enormous scope of the reserves of oil in the Middle East was realized.

This pace of discovery and exploitation continued essentially unchecked until the O.P.E.C. oil embargo in the early 1970's. With the elevated oil prices brought on by the embargo, it now became more economically attractive to utilize wells in a more efficient and measured fashion by fully utilizing the bottom hole pressure within the formation to lift oil to the surface. The present invention is an choke apparatus which both effectively harnesses bottom hole pressure, and also helps to prevent the entry of sand and water into the production string. The present choke device can be used with equal success in wells which are naturally or artificially lifted.

Two natural factors, the presence of sand and water, contribute in large part to the cost of oil drilling and production. In regard to water, most oil wells are choked at the surface. At the bottom of the well, oil is forced out of the formation at a great rate due to the large pressure drop from inside the formation to inside the well casing. This causes "coning" of water from a lower water-bearing zone into the oil-bearing formation, and eventually into the well bore. Essentially, the rapid movement of oil out of the oil-bearing formation and into the well bore creates a vacuum in the formation into which water from lower levels is drawn, or coned. Once a significant amount of water has been coned into the well, it creates downward back pressure which counteracts the upward pressure of the oil-bearing formation. Now, not only must the well be artificially lifted, but eventually, and inexorably, the well and the surrounding formation is coned full of water to the point that the hydrocarbon strata is choked off and the oil contained therein becomes unrecoverable.

Adding greater cost to the difficulty of coned water is the disposal problem which accompanies it. Water that is coned into a well is lifted to the surface with the oil. Strict federal regulations require that the water lifted to the surface be re-injected back into the ground. However, the water lifted is not re-injected back into the well from which it came for fear that it will damage the oil production formations. Therefore the water must be transported to a re-injection well located a safe distance from the oil producing zone. The water is then re-injected into the earth. The present apparatus greatly reduces the amount of coned water which enters the production string, thereby lowering production costs.

The presence of sand in the production stream also adds to the cost of oil production. The deleterious effects of sand are two-fold: First, the sand has a tendency to settle at the bottom of the well, thereby plugging up the production string. Second, sand that enters the production zone must be lifted to the surface, which requires a greater amount of energy than is required to lift the oil alone.

The present apparatus is a choke device which includes a filtering screen down hole of a permanent or releasably fixed choke and a check valve. The choke maintains constant pressure at the production level, which both reduces the amount of coning, and greatly reduces the amount of sand dislodged from the surrounding formation. The presence of the filtering screen adjacent to the production zone ensures that a large proportion, if not all of the sand present in the oil is removed prior to the oil entering the production string.

BRIEF DESCRIPTION OF THE DRAWING

The drawing FIGURE is an elevation view of the choke device according to the present invention.

DETAILED DESCRIPTION OF THE PREFERRED EMBODIMENT

The drawing FIGURE depicts the presently claimed choke apparatus placed inside a standard oil and gas well. The well includes outer casing 1 which includes perforations at its lower end to admit oil from a formation into the casing. Concentrically disposed within casing 1 is production string 2. The production string is a hollow tube into which oil for production will enter to be lifted to the surface, which is to the left in the FIGURE.

Annular packer 3 fills the annulus formed between the casing 1 and the production line 2. The packer prevents water from upper strata from falling down below the lower end of the production string and mixing with the oil being lifted.

A seat 8 is releasably or fixedly located within the production line 2, and forms a seal between an outside diameter of funnel 9, and the production line. A shear plug 7 is placed in funnel 9 to facilitate draining the production string or removing the choke apparatus.

The seat 8 can be any type of conventional seat, including an S-nipple, an R-nipple, an X-nipple, and the like. Optionally, the seat can accommodate an anchor (not shown) for holding funnel 9 in place. Such seating devices are employed based on the type of material being pumped, the geological formation which is being drilled, and other parameters known to one of skill in the drilling art.

Moving down hole, the funnel 9 is releasably attached to a check valve 6. The check valve can be a standing ball valve, as shown, or any type of pressure-responsive one-way flow valve capable of preventing fluid from flowing out of the production string into the well casing.

Releasably mounted directly below the check valve is choke 5. The choke comprises a housing having an inlet at the down-hole end of the choke and an outlet and the up-hole end. The small outlet of the choke decreases the volume of oil entering the production string and increase the pressure gradient across the choke, while mechanically maintaining the pressure at the producing level, i.e. the pressure of the oil as it leaves the oil-bearing formation and ethers the casing, at a constant level.

Adjacent to the inlet of the choke is a screen 4 having a plurality of openings therethrough. The screen serves to prevent sand from entering into the production string. The screen is made of metal, preferably stainless steel, and the openings are smaller in diameter than the outlet of the choke. Preferably the openings in the screen have a diameter of from 1 to 12/64ths of an inch.

If inserted in a releasable fashion, the entire choke apparatus can be installed inside the well bore using well known wire line installation.

In operation, the well is dug to the oil-producing formation and lined with the outer casing 1. Production string 2 is then placed within the casing along with packer 3. The entire choke assembly can be lowered down the casing along with the production string, or lowered through the production string after it has been fixed in place by the packer.

Oil from the formation enters the casing through the perforations wherein it flows through screen 4, choke 5, and past check valve 6. Once past the check valve, if there is sufficient head, the head will lift the oil to the surface. If there is insufficient head to lift the oil to the surface, the check valve 6 will prevent back flow into the formation, and the head above the check valve is lifted to the surface by known means.

In either instance, whether the well is artificially lifted, or naturally lifted, the pressure at the producing level is maintained at a constant level, which can be adjusted by inserting chokes of different inside diameter. By slowly "bleeding" the oil out of the formation, water coning is greatly reduced, and sedimentation is left in place, rather than being agitated and forced into the production string. Any significant amount of oil which is stirred up at the producing level is prevented from entering the production level by screen 4.

Additionally, because very little water or sand enters the production string, more of the formation pressure is utilized to force the oil to the surface. This lessens the amount of energy needed to artificially lift the oil.

Through a number of factors, the present apparatus greatly maximizes oil production from wells. First, it lessens the amount of sand and water in the oil which enters the production string. Second, because pressure at the producing face remains substantially constant, the coning of water is reduced, which allows more oil to be removed from a given formation. Third, because far less water is lifted to the surface, it lessens the cost of operating the oil because there is a much smaller volume of waste water to be re-injected into the earth.

It is to be understood that the present invention is not limited to the embodiments described above, but encompasses any and all embodiments within the scope of the following claims.

I claim:

1. In combination with a well including an outer tubular casing, an inner tubular production string concentrically disposed within said casing and a packer disposed within an annulus defined by an outer surface of said tubular production string and an inner surface of said outer casing, a choke apparatus comprising:

a housing having an inlet and an outlet interconnected by a passageway and a valve seat across said outlet;

a screen including a plurality of openings therethrough, said screen disposed adjacent to said inlet of said housing;

a valve member cooperable with said valve seat to control flow therethrough;

a funnel having large first open end, and a small second open end interconnected by a passageway, said small second open end axially and releasably attached to said housing adjacent to said outlet; and an annular seat having an inside surface and an outside surface, wherein said inside surface of annular seat surrounds an outer surface of said large first open end of said funnel and is releasably engageable therewith, and said outside surface of said annular seat is disposed against and releasably engageable to an inner surface of said production string.

2. The combination according to claim 1, wherein said funnel includes a radial opening therethrough, and further comprises a shear plug disposed within said radial opening.

3. The combination according to claim 1, wherein said screen is fabricated from stainless steel.

4. The combination according to claim 3, wherein said outlet of said housing is a circular opening having a fixed diameter, and wherein each of said plurality of openings through said screen is a circular opening having a fixed diameter, and wherein said diameter of each of said plurality of openings in said screen is smaller than said diameter of said outlet.

5. The combination according to claim 4, wherein said diameter of each of said plurality of openings through said screen is from 1/64th to 12/64ths of an inch.

6. The combination according to claim 1, wherein said inlet and said outlet of said housing have circular cross-sections, and said inlet has a diameter greater than a diameter of said outlet.

7. The combination according to claim 1, wherein said seat is selected from the group consisting of an S-nipple, an R-nipple, and an X-nipple.

8. The combination according to claim 1, wherein said valve member is a standing ball valve.

9. The combination according to claim 1, wherein said choke apparatus is permanently fixed within said production string.

10. A choke apparatus comprising:

a housing having an inlet and an outlet interconnected by a passageway and a valve seat across said cutlet;

a screen including a plurality of openings therethrough, said screen disposed adjacent to said inlet of said housing; and a valve member cooperable with said valve seat to control flow therethrough.

11. The choke apparatus according to claim 10, further may comprise a funnel having large first open end, and a small second open end interconnected by a passageway, said small second open end axially and releasably attached to said housing adjacent to said outlet.

12. The choke apparatus according to claim 11, further comprising an annular seat, wherein said annular seat surrounds an outer surface of said large first open end of said funnel and is releasably engageable therewith.

13. The choke apparatus according to claim 12, wherein said funnel includes a radial opening therethrough, and further comprises a shear plug disposed within said radial opening.

14. The choke apparatus according to claim 10, wherein said screen is fabricated from stainless steel.

15. The choke apparatus according to claim 14, wherein said outlet of said housing is a circular opening having a fixed diameter, and wherein each of said plurality of openings through said screen is a circular opening having a fixed diameter, and wherein said diameter of each of said plurality of openings in said screen is smaller than said diameter of said outlet.

16. The choke apparatus according to claim 15, wherein said diameter of each of said plurality of openings through said screen is from 1/64th to 12/64ths of an inch.

17. The choke apparatus according to claim 10, wherein said inlet and said outlet of said housing have circular cross-sections, and said inlet has a diameter greater than a diameter of said outlet.

18. The choke apparatus according to claim 17, wherein said valve member is a standing ball valve.

19. The choke apparatus according to claim 12, wherein said seat is selected from the group consisting of an S-nipple, an R-nipple, and an X-nipple.

* * * * *